United States Patent [19]

Cook et al.

[11] Patent Number: 4,962,741

[45] Date of Patent: Oct. 16, 1990

[54] INDIVIDUAL CYLINDER AIR/FUEL RATIO FEEDBACK CONTROL SYSTEM

[75] Inventors: Jeffrey A. Cook, Dearborn; Jessy Grizzle, Ann Arbor, both of Mich.

[73] Assignee: Ford Motor Company, Dearborn, Mich.

[21] Appl. No.: 380,062

[22] Filed: Jul. 14, 1989

[51] Int. Cl.[5] ..... F02D 41/14; F02D 41/36

[52] U.S. Cl. ..... 123/489

[58] Field of Search ..... 123/489, 440, 589

[56] References Cited

U.S. PATENT DOCUMENTS

| | | | |
|---|---|---|---|
| 4,111,171 | 9/1978 | Aono et al. | 123/440 |
| 4,337,745 | 7/1982 | Pomerantz | 123/440 |
| 4,483,300 | 11/1984 | Hosaka et al. | 123/489 |
| 4,627,402 | 12/1986 | Saito et al. | 123/440 |
| 4,718,015 | 1/1988 | Grob et al. | 364/431.05 |
| 4,766,870 | 8/1988 | Nakajima et al. | 123/489 |

FOREIGN PATENT DOCUMENTS

| | | | |
|---|---|---|---|
| 3620775 | 1/1987 | Fed. Rep. of Germany | 123/489 |
| 57-102529 | 6/1982 | Japan | 123/489 |
| 59-23046 | 2/1984 | Japan | 123/489 |
| 60-195348 | 10/1985 | Japan | 123/489 |
| 63-243436 | 10/1988 | Japan | 123/489 |

OTHER PUBLICATIONS

Publication FA2-10:00 from Proceedings of the 1987 American Control Conference, Minneapolis, Minnesota, 10-12 Jun. 1987, entitled "Modeling and Analysis of an Inherently Multi-Rate Sampling Fuel Injected Engine Idle Speed Control Loop", by B. K. Power, J. A. Cook, J. W. Grizzle.

*Primary Examiner*—Andrew M. Dolinar

*Attorney, Agent, or Firm*—Allan J. Lippa; Peter Abolins

[57] ABSTRACT

An air/fuel ratio control system and method for correcting the air/fuel ratio for each of N cylinders in an internal combustion engine having electronically actuated fuel injectors coupled to each cylinder. A first air/fuel controller provides a desired fuel command for maintaining an average air/fuel ratio among the cylinders in response to an exhaust gas oxygen sensor and a measurement of inducted air flow. A second air/fuel controller generates N trim signals by sampling the exhaust gas oxygen sensor once each combustion period, synchronizing the samples to generate N nonperiodic samples, correlating the samples with the corresponding combustion event and integrating. The fuel command to each fuel injector is then trimmed for operating each cylinder at a desired air/fuel ratio.

14 Claims, 5 Drawing Sheets

INDIVIDUAL CYLINDER AIR/FUEL RATIO FEEDBACK CONTROL SYSTEM

BACKGROUND OF THE INVENTION

The invention relates to feedback control systems. In one particular aspect, the invention relates to individual cylinder air/fuel ratio feedback control systems for internal combustion engines.

In a typical fuel injected internal combustion engine, electronically actuated fuel injectors inject fuel into the intake manifold where it is mixed with air for induction into the engine cylinders. During open loop operation, inducted air flow is measured and a corresponding amount of fuel is injected such that the intake air/fuel ratio is near a desired value.

Air/fuel ratio feedback control systems are also known for controlling the average air/fuel ratio among the cylinders. In a typical system, an exhaust gas oxygen sensor is positioned in the engine exhaust for providing a rough indication of actual air/fuel ratio. These sensors are usually switching sensors which switch between lean and rich operation. The conventional air/fuel ratio control system corrects the open loop fuel calculation in response to the exhaust gas oxygen content for maintaining the average air/fuel ratios among the cylinders around a reference value. Typically, the reference value is chosen to be within the operating window of a three-way catalytic converter ($NO_x$, CO, and HC) for maximizing converter efficiency.

A problem with the conventional air/fuel ratio control system is that only the average air/fuel ratio among cylinders is controlled. There may be variations in the air/fuel ratio of each cylinder even though the average of all cylinders is corrected to be a desired value. Variations in fuel injector tolerances, component aging, engine thermodynamics, air/fuel mixing through the intake manifold, and variations in fluid flow into each cylinder may cause maldistribution of air/fuel ratio among each cylinder. This maldistribution results in less than optimal performance. Further, air/fuel ratio variations may cause rapid switching, referred to as buzzing, and saturation of the EGO sensor.

One approach to regulating air/fuel ratio on an individual cylinder basis is described in U.S. Pat. No. 4,483,300 issued to Hosoka et al. In this approach, small variations in a two-state switching EGO sensor are measured to, allegedly, determine fluctuations in individual cylinder air/fuel characteristics. In response to this measurement, the appropriate injector is regulated. The inventors herein contend that, at best, it is difficult to measure such small variations in the EGO output, and such measurement would have a poor signal/noise ratio. Further, the typical EGO sensor is easily saturated such that the needed signal variations may not be available.

The inventors herein have recognized that maldistribution of air/fuel ratio among the cylinders results in periodic, time variant, fluctuations in the EGO sensor output. For example, if one cylinder is offset in a rich direction, the EGO signal would periodically show a rich perturbation during a time associated with combustion in that cylinder. Accordingly, conventional feedback control techniques, which require nonperiodic inputs, are not amenable to individual cylinder air/fuel ratio control.

SUMMARY OF THE INVENTION

An object of the invention herein is to provide a sampled control system for maintaining the air/fuel ratio of each cylinder at substantially a desired air/fuel ratio. The above problems and disadvantages are overcome, and object achieved, by providing both a control system and a method for correcting air/fuel ratios for each of N cylinders via an oxygen sensor positioned in the exhaust of an internal combustion engine. In one particular aspect of the invention, the method comprises the steps of: sampling the sensor once each period associated with a combustion event in one of the cylinders to generate N periodic output signals; storing each of the N periodic output signals; concurrently reading each of the N periodic output signals from the storage once each output period to define N nonperiodic correction signals each being related to the air/fuel ratio of a corresponding cylinder wherein the output period is defined as a predetermined number of engine revolutions required for each of the cylinders to have a single combustion event; and correcting a mixture of air and fuel supplied to each of the cylinders in response to each of the correction signals.

By utilizing the sampling and reading steps described above, an advantage is obtained of converting a periodic, time variant, sensor output into a nonperiodic, time invariant, signal. Thus, conventional feedback control techniques may be used to advantage for obtaining individual cylinder air/fuel ratio control which was not heretofore possible.

In another aspect of the invention, the method comprises the steps of: providing a correction signal in response to the oxygen sensor related to an offset in average air/fuel ratio among all the cylinders; correcting a reference air/fuel ratio signal in response to the correction signal; generating a single desired fuel charge for delivery to each of the cylinders to provide a desired average air/fuel ratio among all the cylinders; sampling the oxygen sensor once each period associated with a combustion event in one of the cylinders to generate N periodic output signals; storing each of the N periodic output signals; concurrently reading each of the N periodic output signals from the storage once each output period to define N nonperiodic correction signals each being related to the air/fuel ratio of a corresponding cylinder wherein the output period is defined as a predetermined number of engine revolutions required for each of the cylinders to have a single combustion event; and correcting the desired fuel charge to generate a separate corrected fuel charge for each of the cylinders in response to each of the correction signals thereby providing a desired air/fuel ratio for each of the cylinders.

An advantage of the above aspect of the invention is that the average air/fuel ratio among the cylinders is corrected on an individual cylinder basis by utilizing known feedback control techniques.

BRIEF DESCRIPTION OF THE DRAWINGS

The objects and advantages described herein will be more fully understood by reading the Description of the Preferred Embodiment with reference to the drawings wherein.

DESCRIPTION OF THE PREFERRED EMBODIMENT

Figure 1:
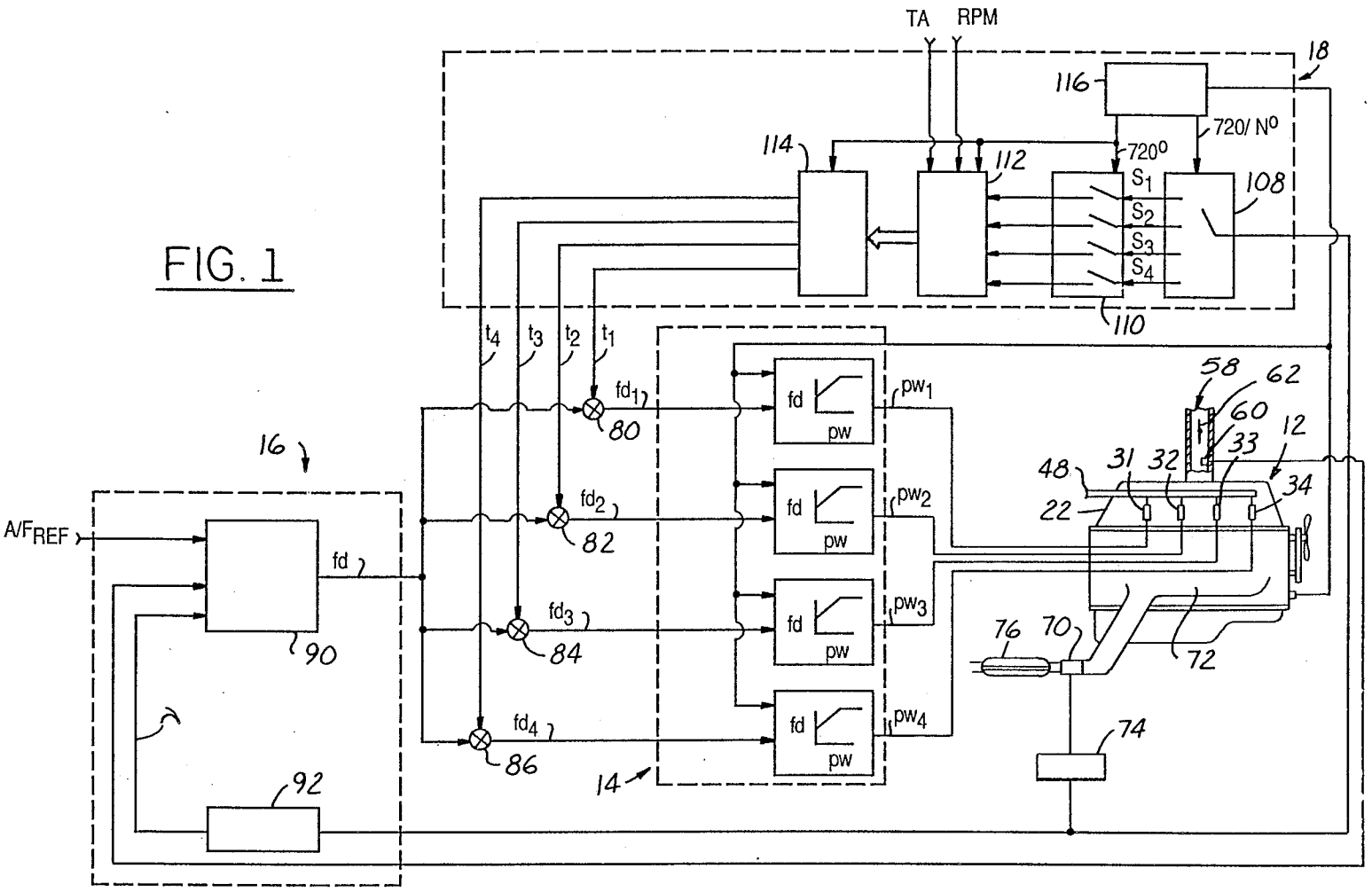
FIG. 1 is a block diagram of a system wherein the invention is utilized to advantage.

Referring to FIG. 1, in general terms which are described in greater detail later herein, internal combustion engine 12 is shown coupled to fuel controller 14, average air/fuel controller 16, and individual cylinder air/fuel controller 18. In this particular example which is referred to as a preferred embodiment, engine 12 is a 4-cycle, 4-cylinder internal combustion engine having intake manifold 22 with electronically actuated fuel injectors 31, 32, 33, and 34 coupled thereto in proximity to respective combustion cylinders 41, 42, 43, and 44 (not shown). This type of fuel injection system is commonly referred to as port injection. Air intake 58, having mass air flow meter 60 and throttle plate 62 coupled thereto, is shown communicating with intake manifold 22.

Fuel rail 48 is shown connected to fuel injectors 31, 32, 33, and 34 for supplying pressurized fuel from a conventional fuel tank and fuel pump (not shown). Fuel injectors 31, 32, 33, and 34 are electronically actuated by respective signals $pw_1$, $pw_2$, $pw_3$, and $pw_4$ from fuel controller 14 for supplying fuel to respective cylinders 41, 42, 43, and 44 in proportion to the pulse width of signals $pw_{1-4}$.

Exhaust gas oxygen sensor (EGO) 70, a conventional 2-state EGO sensor in this example, provides via filter 74 an ego signal related to the average air/fuel ratio among cylinders 41–44. When the average air/fuel ratio among cylinders 41–44 rises above a reference value, EGO sensor 70 switches to a high output. Similarly, when the average air/fuel ratio among cylinders 41–44 falls below a reference value, EGO sensor 70 switches to a low output. This reference value is typically correlated with an air/fuel ratio of 14.7 lbs air per 1 lb of fuel and is referred to herein as stoichiometry. The operating window of 3-way catalytic converter 76 is centered at stoichiometry for maximizing the amounts of $NO_x$, CO, and HC emissions to be removed.

As described in greater detail later herein, average air/fuel controller 16 provides fuel demand signal fd in response to mass air flow (MAF) signal from mass air flow meter 60 and the feedback ego signal from EGO sensor 70. Fuel demand signal fd is provided such that fuel injectors 31–34 will collectively deliver the demanded amount of fuel for achieving an average air/fuel ratio among the cylinders of 14.7 lbs air/lb fuel in this particular example.

Individual cylinder air/fuel controller 18 provides trim signals $t_1$, $t_2$, $t_3$, and $t_4$ in response to the feedback ego signal and other system state variables such as engine speed (RPM) and engine load or throttle angle (TA). Trim signals $t_{1-4}$ provide corrections to fuel demand signal fd for achieving the desired air/fuel ratio for each individual cylinder. In this particular example, trim signals $t_{1-4}$ correct fuel demand signal fd via respective summers 80, 82, 84, and 86 for providing corrected fuel demand signals $fd_1$, $fd_2$, $fd_3$, and $fd_4$. Fuel controller 14 then provides electronic signals $pw_{1-4}$, each having a pulse width related to respective $fd_{1-4}$ signals, such that injectors 31–34 provide a fuel amount for achieving the desired air/fuel ratio in each individual cylinder.

Figure 2:
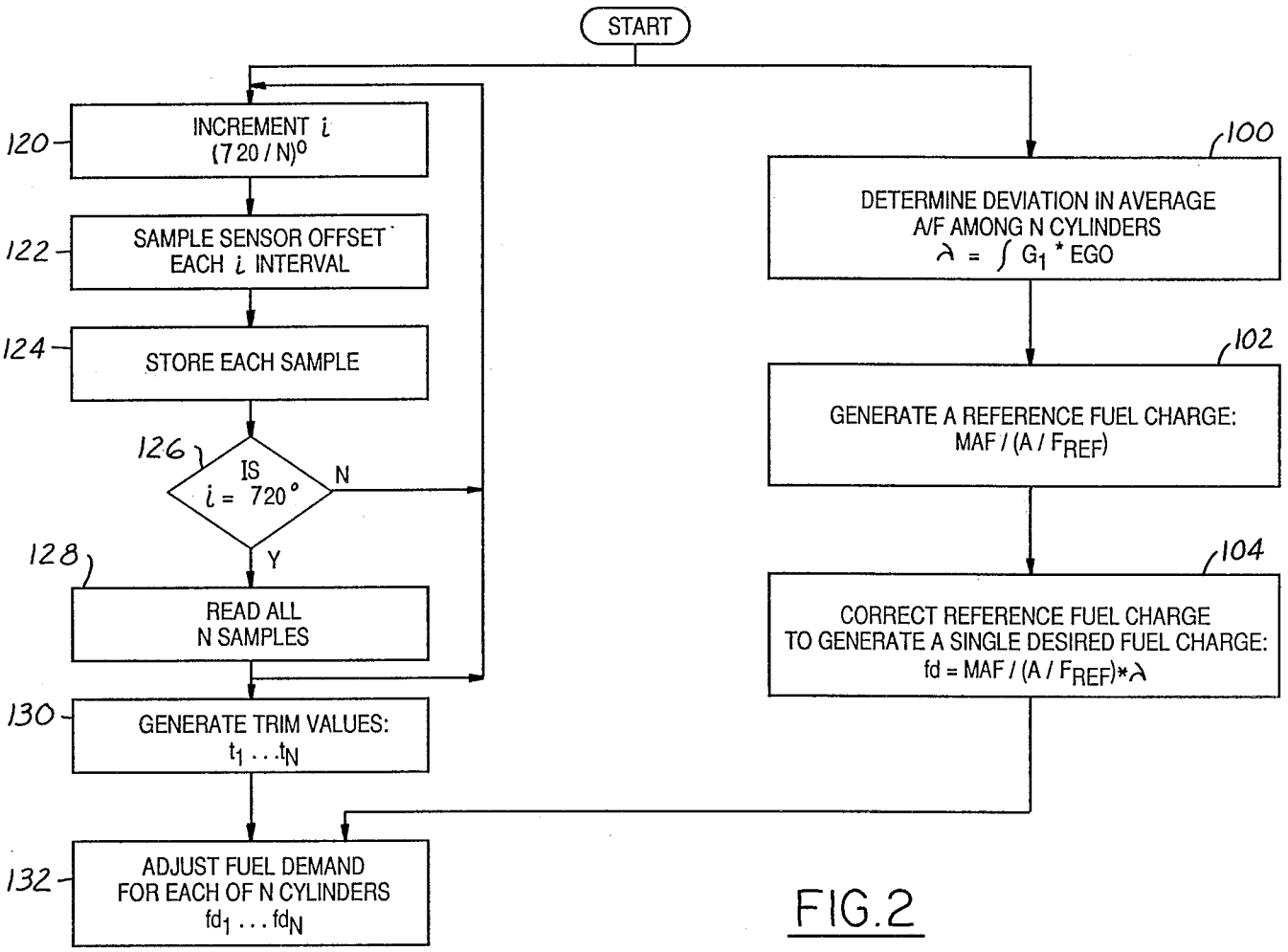
FIG. 2 is a flow diagram of various process steps performed by the embodiment shown in FIG. 1.

Continuing with FIG. 1, and process steps 100, 102 and 104 shown in FIG. 2, the structure and operation of average air/fuel controller 16 is now described in more detail. Average air/fuel controller 16 includes conventional feedback controller 90, a proportional integral feedback controller in this example, and multiplier 92. In a conventional manner, feedback controller 90 generates corrective factor lambda ($\lambda$) by multiplying the ego signal by a gain factor ($G_1$) and integrating as shown by step 100. Correction factor $\lambda$ is therefore related to the deviation in average air/fuel ratio among cylinders 1–4 from the reference air/fuel ratio. Multiplier 92 multiplies the inverse of the reference or desired air/fuel ratio times the MAF signal to achieve a reference fuel charge. This value is then offset by correction factor $\lambda$ from feedback controller 90 to generate desired fuel charge signal fd.

It is noted that average air/fuel ratio control is limited to maintaining the average air/fuel ratio among the cylinders near a reference value. The air/fuel ratio will most likely vary among each cylinder due to such factors as fuel injector tolerances and wear, engine thermodynamics, variations in air/fuel mixing through intake manifold 22, and variations in cylinder compression and intake flow. These variations in individual cylinder air/fuel ratios result in less than optimal performance. Further, a cylinder having an offset air/fuel ratio leads to periodic excursions in exhaust gas oxygen content possibly resulting in periodic saturation of EGO sensor 76 and also rapid oscillations in average air/fuel ratio (see FIG. 4 between times $T_0$ and $T_5$). Individual cylinder air/fuel controller 18 solves these problems as described below.

Referring back to FIG. 1, individual cylinder air/fuel controller 18 is shown including demultiplexer 108, synchronizer 110, observer 112, controller 114, and timing circuit 116. In general, demultiplexer 108 and synchronizer 110 convert the time varying, periodic output of the ego signal into time invariant, sampled signals suitable for processing in a conventional feedback controller. Stated another way, the ego signal is time variant or periodic because variations in individual air/fuel ratios of the cylinders result in periodic fluctuations of the exhaust output. These periodic variations are not amenable to feedback control by conventional techniques. Demultiplexer 108 and synchronizer 110 convert the ego signal into four individual signals ($S_1$, $S_2$, $S_3$, and $S_4$) which are time invariant or nonperiodic. Observer 112 correlates information from signals $S_{1-4}$ to the previous combustion event for each cylinder.

Figure 3:
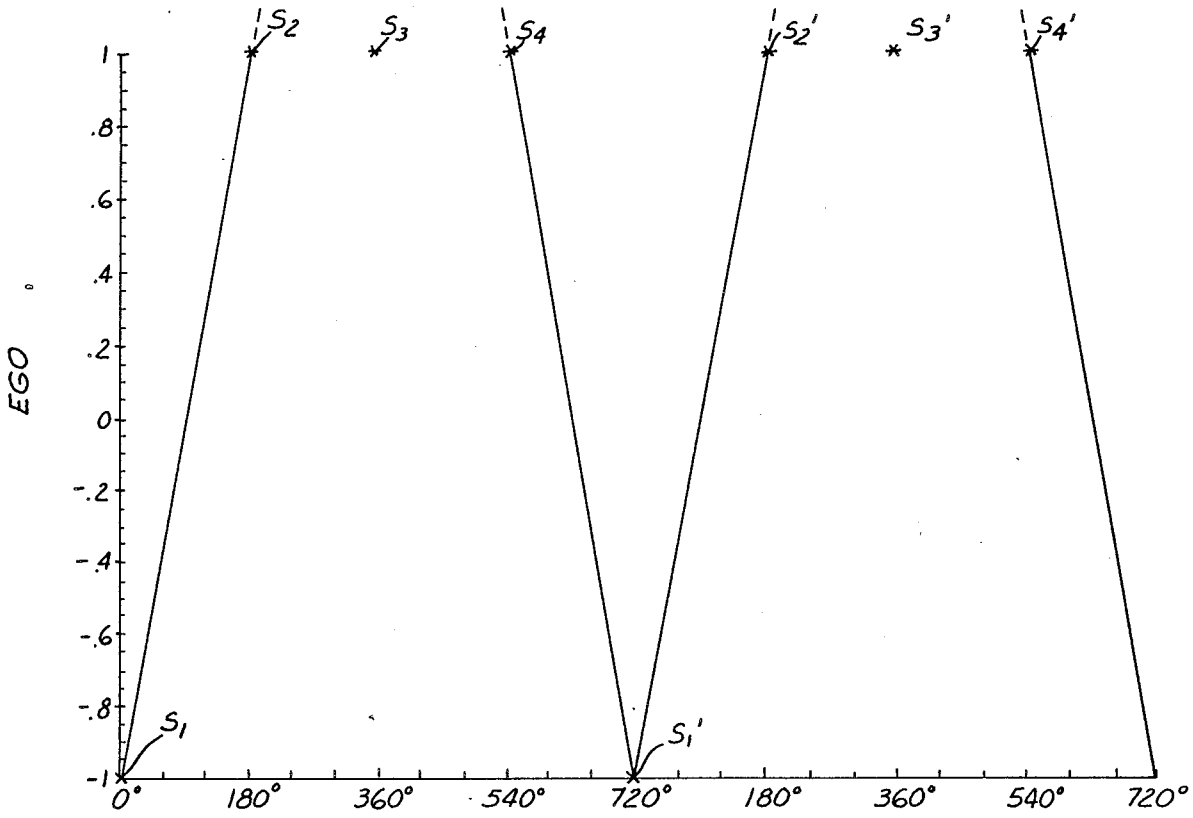
FIG. 3 is a graphical representation of signal sampling described with reference to FIGS. 1 and 2.
Figure 4A:
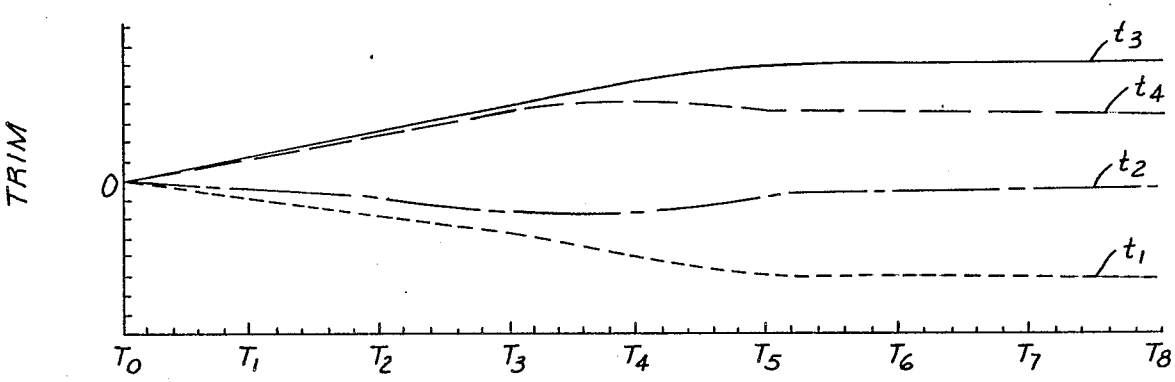
FIG. 4A is a graphical representation of various control signals generated by the embodiment shown in FIG. 1.
Figure 4B:
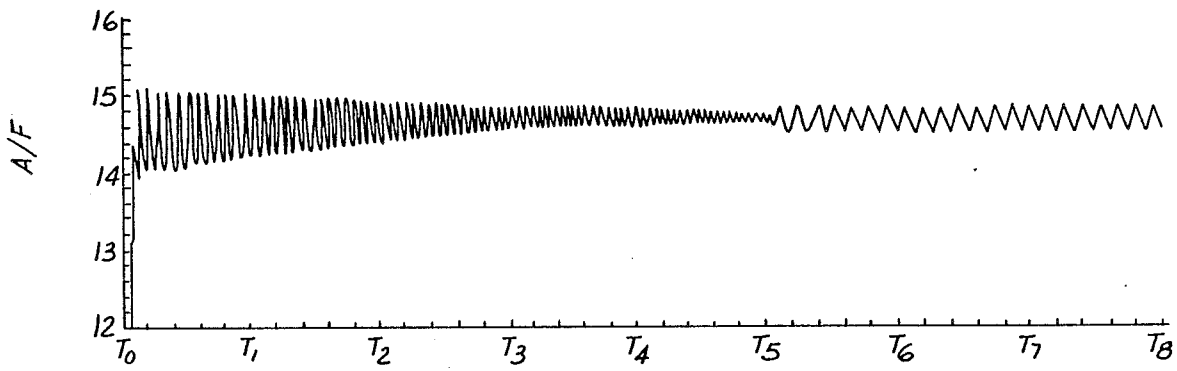
FIG. 4B is a graphical representation of the effect the control signals illustrated in FIG. 4A have on air/fuel ratio.

The operation of individual cylinder air/fuel controller 18 is now described in more detail with continuing reference to FIG. 1, reference to the process step shown in FIG. 2, reference to the graphical representation of the ego signal shown in FIG. 3, and reference to the graphical representation of controller 18 output shown with its effect on overall air/fuel ratio in FIGS. 4A and 4B. Demultiplexer 108 includes a conventional A/D converter (not shown) sampled every 720/N°, for a four stroke engine, where N=the number of engine cylinders. In the case of a 2-cycle engine, the sample rate (i) is 360/N°. For the example presented herein, N=4 such that the sample rate (i) is 180°. Referring to steps 120, 122 124 and 126, the ego signal is sampled at a sample rate (i) of 180° until four samples ($S_{1-4}$) are taken (i.e. 720°). Each sample is stored in a separate storage location.

Referring for illustrative purposes to FIG. 3, an expanded view of the ego signal is shown. Samples $S_{1-4}$ are shown taken every 180° for a 720° output period associated with one engine cycle. During a subsequent engine cycle, another four samples ($S_{1-4}$) are taken. It is also shown in this example that the sampled values of the ego signal are limited to an upper threshold associated with lean operation (1 volt in this example) and a lower threshold associated with rich operation (minus one volt in this example). This 2-state sample information has been found to be adequate for achieving individual air/fuel ratio control.

Referring to synchronizer 110 shown in FIG. 1, and step 128 in FIG. 2, all four samples ($S_{1-4}$) are simultaneously read from storage each output period of 720°. Accordingly, on each 720° output period, four simultaneous samples are read which are now time invariant or nonperiodic sampled signals. In response to each sampled signal ($S_{1-4}$), and also in response to engine speed (RPM) and engine load (TA) signals, observer 112 predicts the air/fuel ratio conditions in the corresponding cylinder utilizing conventional techniques. For example, at a particular engine speed and load, a combustion event in one cylinder will effect the ego signal a predetermined time afterwards.

Controller 114, a proportional integral controller operating at a sample rate of 720° in this example, then generates four trim values $t_1$, $t_2$, $t_3$, and $t_4$ as shown by step 130 in FIG. 2. Each trim value is then added to, or subtracted from, fuel demand signal fd in respective summers 80, 82, 84, and 86 to generate respective individual fuel demand signals $fd_1$, $fd_2$, $fd_3$, and $fd_4$ as shown by step 132. In response, fuel controller 14 provides corresponding pulse width signals $pw_{1-4}$ for actuating respective fuel injectors 31–34.

The affect of individual cylinder air/fuel feedback controller 18 is shown graphically in FIGS. 4A and 4B. For the particular example shown therein, cylinder one is running lean, and cylinders three and four are running rich. The corresponding air/fuel ratio is shown rapidly switching under control of average air/fuel controller 16 before time $T_5$ for reasons described previously herein. By time $T_5$ individual cylinder air/fuel controller 18 fully generates trim signals $t_{1-4}$ such that each individual cylinder is operating near the reference air/fuel ratio. The corresponding average air/fuel ratio is therefore shown entering a desired switching mode after time $T_5$. Any switching excursions shown are inherent to a proportional integral feedback control and are within limits of EGO sensor 70.

Figure 5:
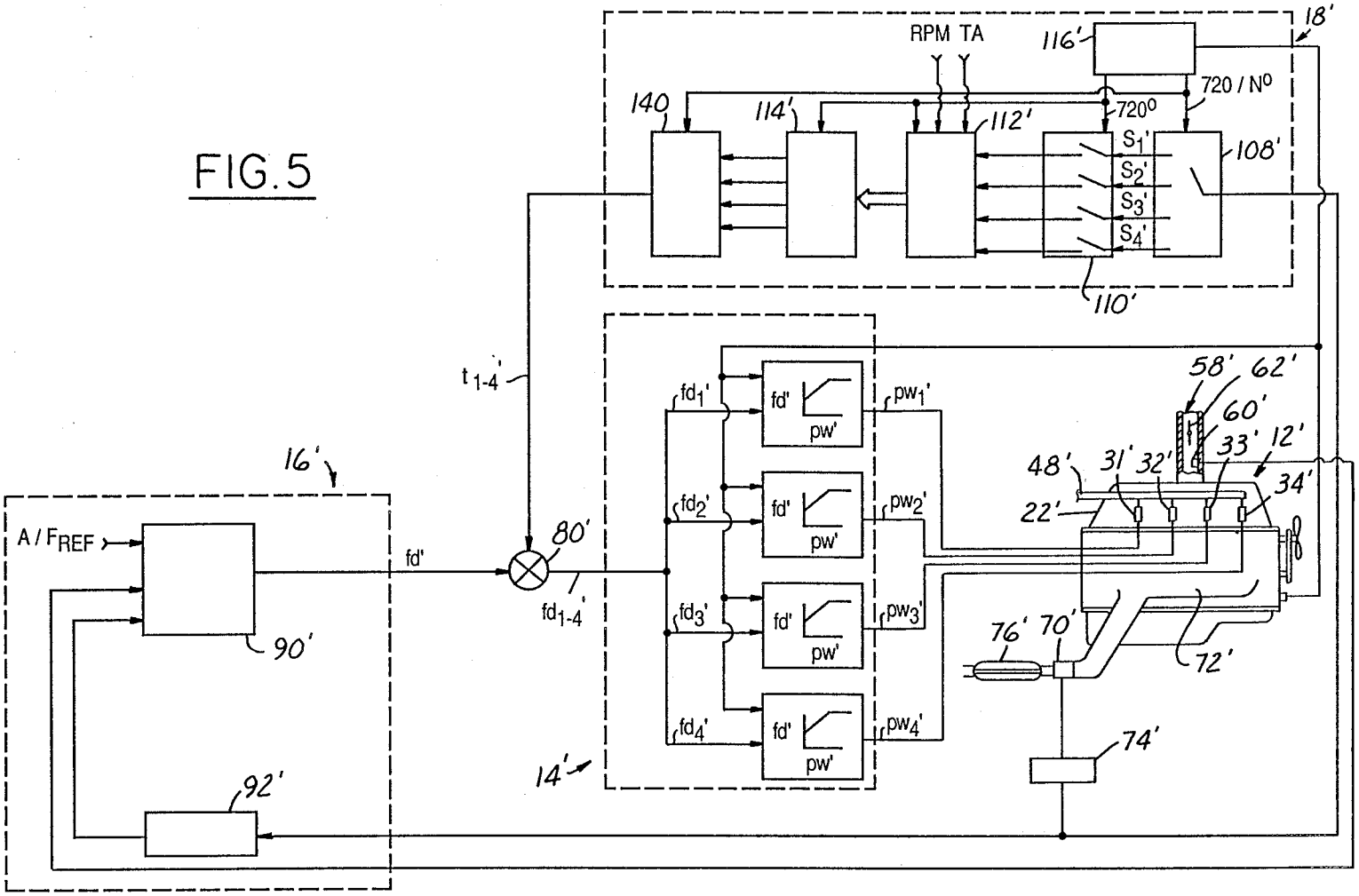
FIG. 5 is an alternate embodiment to the embodiment shown in FIG. 1.

An alternate embodiment in which the invention is used to advantage is shown in FIG. 5 wherein like numerals refer to like parts shown in FIG. 1. The structure shown in FIG. 5 is substantially similar to that shown in FIG. 1 with the exception that trim signals $t_{1-4}$ are multiplexed in multiplexer 140' and, accordingly, only one summer (80') is needed. Since fuel delivery to each cylinder is sequenced in 180° increments, trim signals $t_{1-4}$ are serially provided to summer 80' for modifying fuel demand signal fd. In this manner, fuel demand signal fd is trimmed in a time sequence corresponding to fuel delivery for the cylinder being controlled. Other than this multiplexing scheme, the operation of the embodiment shown in FIG. 5 is substantially the same as the operation of the embodiment shown in FIG. 1.

This concludes the Description of the Preferred Embodiment. The reading of it by those skilled in the art will bring to mind many alterations and modifications without departing from the spirit and scope of the invention. For example, the invention described herein is equally applicable to 2-stroke engines. It may also be used to advantage with engines having any number of cylinders and fuel injection systems different from those described herein. A banked fuel injection system wherein groups or banks of fuel injectors are simultaneously fired is an example of another type of fuel injection system in which the invention may be used to advantage. Accordingly, it is intended that the scope of the invention be limited only by the following claims.

What is claimed:

1. A method for correcting air/fuel ratio for each of N cylinders via an oxygen sensor positioned in the exhaust of an internal combustion engine, comprising the steps of:

sampling the sensor once each period associated with a combustion event in one of the cylinders to generate N output signals;

storing each of said N output signals;

concurrently reading each of said N output signals from said storage once each output period to define N nonperiodic signals each being related to the air/fuel ratio of a corresponding cylinder wherein said output period is defined as a predetermined number of engine revolutions required for each of the cylinders to have a single combustion event;

generating N feedback correction signals from said N nonperiodic signals; and correcting a mixture of air and fuel supplied to each of the cylinders in response to each of said feedback correction signals for achieving a desired air/fuel ratio in each of the cylinders.

2. The method recited in claim 1 wherein said output period is 720 degrees.

3. The method recited in claim 1 further comprising the step of metering fuel supplied to the engine via fuel injectors coupled to the engine in response to said correcting step.

4. A method for correcting air/fuel ratio for each of N cylinders via an oxygen sensor positioned in the exhaust of an internal, combustion engine, comprising the steps of:

delivering a desired fuel charge to each of the cylinders to provide a desired average air/fuel ratio among all the cylinders in response to the oxygen sensor;

sampling the oxygen sensor once each period associated with a combustion event in one of the cylinders to generate N output signals;

synchronizing said N output signals once each output period for generating N nonperiodic correction signals each being related to the air/fuel ratio of a corresponding cylinder wherein said output period is defined as a predetermined number of engine revolutions required for each of the cylinders to have a single combustion event; and correcting said desired fuel charge to generate a separate corrected fuel charge for each of the cylinders in response to each of said correction signals thereby providing a desired air/fuel ratio for each of the cylinders.

5. The method recited in claim 4 wherein said delivering step is further responsive to a measurement of airflow inducted into the engine.

6. The method recited in claim 4 wherein said sampling step includes sampling the sensor output at both an upper threshold value and a lower threshold value.

7. An apparatus for correcting air/fuel ratio for each of N cylinders via an oxygen sensor positioned in the exhaust of an internal combustion engine, comprising:

sampling means for sampling the sensor once each period associated with a combustion event in one of the cylinders to generate and store N output signals;

synchronizing means for concurrently reading each of said N output signals once each output period to define N nonperiodic signals each being related to the air/fuel ratio of a corresponding cylinder wherein said output period is defined as a predetermined number of engine revolutions required for each of the cylinders to have a single combustion event;

generating means for generating N feedback correction signals from said N nonperiodic signals; and correcting means for correcting a mixture of air and fuel supplied to each of the cylinders in response to each of said feedback correction signals for achieving a desired air/fuel ratio in each of the cylinders.

8. The apparatus recited in claim 7 further comprising;

a plurality of electronically actuated fuel injectors coupled to the engine for supplying fuel to the N cylinders; and a fuel controller responsive to said correcting means for electronically actuating said fuel injectors.

9. The apparatus recited in claim 8 wherein said fuel controller is further responsive to an airflow meter for measuring airflow inducted into the engine.

10. An apparatus for correcting air/fuel ratio for each of N cylinders via an oxygen sensor positioned in the exhaust of an internal combustion engine, comprising:

a first air/fuel controller for adjusting a desired fuel charge delivered to each of the cylinders to provide a desired average air/fuel ratio among all the cylinders in response to the oxygen sensor;

sampling means for sampling the oxygen sensor once each period associated with a combustion event in one of the cylinders to generate N output signals;

synchronizing means for synchronizing said N output signals once each output period for generating N nonperiodic correction signals each being related to the air/fuel ratio of a corresponding cylinder wherein said output period is defined as a predetermined number of engine revolutions required for each of the cylinders to have a single combustion event; and a second air/fuel controller for correcting said desired fuel charge to generate a separate corrected fuel charge for each of the cylinders in response to each of said correction signals thereby providing a desired air/fuel ratio for each of the cylinders.

11. The apparatus recited in claim 10 wherein said sampling means further comprises means for sampling the sensor output at both an upper threshold value and a lower threshold value.

12. The apparatus recited in claim 10 wherein said output period is 720 degrees.

13. The method recited in claim 10 wherein said first air/fuel controller is further responsive to a measurement of airflow inducted into the engine.

14. An apparatus for correcting air/fuel ratio of each of N cylinders in an internal combustion engine having an air/fuel intake manifold with N fuel injectors coupled thereto in proximity to the N cylinders, comprising:

an exhaust gas oxygen sensor for providing an indication of air/fuel ratio from the engine exhaust;

an airflow sensor for providing a measurement of airflow inducted into the engine;

first air/fuel control means responsive to both said exhaust gas oxygen sensor and said airflow sensor for providing a fuel demand signal related to a desired average air/fuel ratio among the N cylinders;

sampling means for sampling the oxygen sensor once each period associated with a combustion event in one of the cylinders to generate N output signals;

synchronizing means for synchronizing said N output signals once each output period for generating N nonperiodic correction signals each being related to the air/fuel ratio of a corresponding cylinder wherein said output period is defined as a predetermined number of engine revolutions required for each of the cylinders to have a single combustion event; and a second air/fuel controller for correcting said desired fuel charge to generate a separate corrected fuel charge for each of the cylinders in response to each of said correction signals thereby providing a desired air/fuel ratio for each of the cylinders.

* * * * *